US010964516B2

(12) United States Patent
Shichi

(10) Patent No.: US 10,964,516 B2
(45) Date of Patent: Mar. 30, 2021

(54) MASS SPECTROMETER, ION GENERATION TIME CONTROL METHOD AND NON-TRANSITORY COMPUTER READABLE MEDIUM

(71) Applicant: SHIMADZU CORPORATION, Kyoto (JP)

(72) Inventor: Hideharu Shichi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 13 days.

(21) Appl. No.: 16/598,566

(22) Filed: Oct. 10, 2019

(65) Prior Publication Data

US 2020/0161113 A1 May 21, 2020

(30) Foreign Application Priority Data

Nov. 21, 2018 (JP) ..... JP2018-218638

(51) Int. Cl.
*H01J 49/02* (2006.01)
*H01J 49/16* (2006.01)

(52) U.S. Cl.
CPC ..... *H01J 49/022* (2013.01); *H01J 49/164* (2013.01)

(58) Field of Classification Search
CPC ..... H01J 49/022; H01J 49/164
See application file for complete search history.

(56) References Cited

U.S. PATENT DOCUMENTS

2010/0116982 A1 5/2010 Iwamoto et al.

FOREIGN PATENT DOCUMENTS

JP 4894916 B2 3/2012

*Primary Examiner* — Nicole M Ippolito
*Assistant Examiner* — Hanway Chang
(74) *Attorney, Agent, or Firm* — Oblon, McClelland, Maier & Neustadt, L.L.P.

(57) ABSTRACT

A mass spectrometer includes an ion source that generates ions, an ion trap that captures the ions generated from the ion source, a detector that detects the ions ejected from the ion trap and a controller that controls a periodic voltage, which is added to form a capturing electric field in the ion trap and controls a time point at which the ions are generated from the ion source. The controller includes an ion generation time controller that allows the ions to be generated from the ion source at N (N is an integer equal to or larger than 2) phase time points while addition of the periodic voltage is continued, the N phase time points being set in one period of the periodic voltage and being respectively assigned to different periods of the periodic voltage.

7 Claims, 7 Drawing Sheets

MASS SPECTROMETER, ION GENERATION TIME CONTROL METHOD AND NON-TRANSITORY COMPUTER READABLE MEDIUM

BACKGROUND OF THE INVENTION

Field of the Invention

The present invention relates to a mass spectrometer, an ion generation time control method that is used in the mass spectrometer, and a non-transitory computer readable medium storing an ion generation time control program.

Description of Related Art

A mass spectrometer includes an ion source that ionizes a sample, an ion separator that mass-separates the ions generated from the ion source and a detector that detects the ions that have been mass-separated in the ion separator. Further, a mass spectrometer, which uses a MALDI ion source utilizing MALDI (Matrix Assisted Laser Desorption/Ionization) as the ion source and uses an ion trap as the ion separator, has been known.

In the MALDI ion source, a sample matrix mixture is irradiated with laser light, which is an ultraviolet ray. The laser light is emitted in the pulse form. Thus, the pulse-form ions are generated from the MALDI ion source.

The ions generated from the MALDI ion source are introduced into the ion trap. A square-wave voltage is added to a ring electrode of the ion trap, and the ions are captured in an ion trap region in the ion trap. A cooling gas is supplied into the ion trap in advance, and the kinetic energy of the captured ions is reduced by the cooling gas. Thus, the ions are stably captured in the ion trap. Then, a high frequency voltage is added to the end-cap electrode of the ion trap, so that the ions having a specific mass are resonantly excited, and the excited ions are discharged from the ion trap.

The ions that have the specific mass and are discharged from the ion trap are detected in the detector. Mass analysis is carried out on the ions detected in the detector in a data processing device. JP 4894916 B2 discloses a mass spectrometer including a MALDI ion source and an ion trap.

BRIEF SUMMARY OF THE INVENTION

As described above, the square-wave voltage is added to the ring electrode of the ion trap, so that ions are captured in the ion trap. However, ions are not introduced into the ion trap efficiently while the square-wave voltage is being added to the ring electrode. As such, there is the method of setting the square-wave voltage added to the ring electrode to 0 V and then increasing the square-wave voltage after ions are introduced into the ion trap. However, the method of increasing the square-wave voltage from 0 V causes a large change in current load in the power supply at the time of the increase, so that waveform deformation of the square-wave voltage may occur. In order for ions to be captured efficiently, the square-wave voltage is desirably in the waveform without deformation.

Further, generally in the MALDI ion source, the amount of ions generated by one-time laser light emittance is often not sufficient. Therefore, the mass spectrum acquired by the one-time mass spectrometry may not satisfy the required S/N ratio. As such, in the mass spectrometer disclosed by JP 4894916 B2, ions are introduced additionally with ions captured in the ion trap.

However, as described above, ions are not introduced into the ion trap efficiently while the square-wave voltage is being added to the ring electrode. This is because an electric field is formed in the ion trap during a period in which ions are captured in the ion trap. Therefore, in order for ions to be introduced additionally with ions captured, phases of the square-wave voltage added to the ion trap are required to be synchronized with the time points at which laser light is emitted to a sample. In the mass spectrometer disclosed by JP 4894916 B2, the time points at which laser light is emitted are controlled such that ions are introduced additionally into the ion trap when the ions captured in the ion trap move towards the center of the ion trap region. That is, the time points at which laser light is emitted are controlled such that ions arrive in the ion trap when an ion cloud is about to change from an expanded state to a reduced state in the trap region. Thus, the mass spectrometer disclosed by JP 4894916 B2 can improve the S/N ratio of the mass spectrum acquired by the one-time mass spectrometry. The mass spectrometer disclosed by JP 4894916 B2 is effective as the method of additionally introducing the ions having a specific mass into the ion trap.

An object of the present invention is to provide a mass spectrometer and an ion generation time control method for enabling prevention of waveform deformation of a square-wave voltage added to an ion trap and enabling ions to be introduced additionally and effectively into the ion trap, and a non-transitory computer readable medium storing the ion generation time control program.

(1) A mass spectrometer according to one aspect of the present invention includes an ion source that generates ions, an ion trap that captures the ions generated from the ion source, a detector that detects the ions ejected from the ion trap, and a controller that controls a periodic voltage, which is added to form a capturing electric field in the ion trap and controls a time point at which the ions are generated from the ion source. The controller includes an ion generation time controller that allows the ions to be generated from the ion source at N (N is an integer equal to or larger than 2) phase time points while addition of the periodic voltage is continued, the N phase time points being set in one period of the periodic voltage and being respectively assigned to different periods of the periodic voltage.

This mass spectrometer allows pulse-form ions to be generated from the ion source at the N phase time points when addition of the periodic voltage is continued in the ion trap. When the pulse-form ions generated form the ion source are introduced into the ion trap, an occurrence of waveform deformation of the periodic voltage is prevented. Thus, the ions introduced from the ion source are captured efficiently in the ion trap.

Further, this mass spectrometer allows the ions generated from the ion source at the N phase time points to be captured in the ion trap. Because the ions generated by the N-time laser light emittance are captured in the ion trap, the amount of ions acquired in a one-time mass separation-detection process is increased.

When ions are generated from the ion source at the N phase time points, the periodic voltage is being added to the ion trap. That is, when ions are generated from the ion source at the N phase time points, the capturing electric field is formed in the ion trap. Therefore, while the ions that arrive when an ion cloud in the ion trap is changing from an expanded state to a reduced state are likely to be introduced into the ion trap, the ions that arrive when the ion cloud in the ion trap is changing from the reduced state to the expanded state are unlikely to be introduced into the ion trap. Further, the time length required for the ions generated from the ion source to arrive in the ion trap depends on the mass of the ions. As such, the N phase time points are set in the one period of the periodic voltage in this mass spectrometer, so that the ions having masses in a wide range are captured in the ion trap.

(2) In this mass spectrometer, the periodic voltage that is added to form the capturing electric field in the ion trap may include a square wave.

(3) The ion generation time controller may set the N phase time points by equally dividing the one period of the periodic voltage into N. The N phase time points are set evenly in the one period of the periodic voltage. The ions having masses in a wide range are captured in the ion trap without restriction to the specific mass.

(4) The ion generation time controller may set a period of a voltage to which the N phase time points are assigned with cooling periods respectively provided between two phase time points.

The N phase time points are set with the cooling periods respectively provided between two phase time points. The ions generated at one phase time point are captured in the ion trap, and then the ions are introduced at the next phase time point after the concentration of the cooling gas outside of the ion trap is reduced. The concentration of the cooling gas outside of the ion trap, in particular, around the inlet port of ions to the ion trap is reduced, so that the additional ions are introduced efficiently into the ion trap.

(5) The ion source may include a MALDI ion source utilizing MALDI (Matrix Assisted Laser Desorption/Ionization).

(6) An ion generation time control method according to another aspect of the present invention include forming a capturing electric field for capturing ions generated from an ion source in an ion trap by adding a periodic voltage, and generating the ions from the ion source at N (N is an integer equal to or larger than 2) phase time points while addition of the periodic voltage is continued, the N phase time points being set in one period of the periodic voltage and being respectively assigned to different periods of the periodic voltage.

(7) A non-transitory computer readable medium storing an ion generation time control program according to yet another aspect of the present invention, the ion generation time control program in the mass spectrometer, allowing a computer to perform a process of controlling a periodic voltage added to form a capturing electric field for capturing ions generated from an ion source in an ion trap, and a process of generating the ions from the ion source at N (N is an integer equal to or larger than 2) phase time points while addition of the periodic voltage is continued, the N phase time points being set in one period of the periodic voltage and being respectively assigned to different periods of the periodic voltage.

Other features, elements, characteristics, and advantages of the present invention will become more apparent from the following description of preferred embodiments of the present invention with reference to the attached drawings.

DESCRIPTION OF THE PREFERRED EMBODIMENTS

(1) Overall Configuration of Mass Spectrometer

Figure 1:
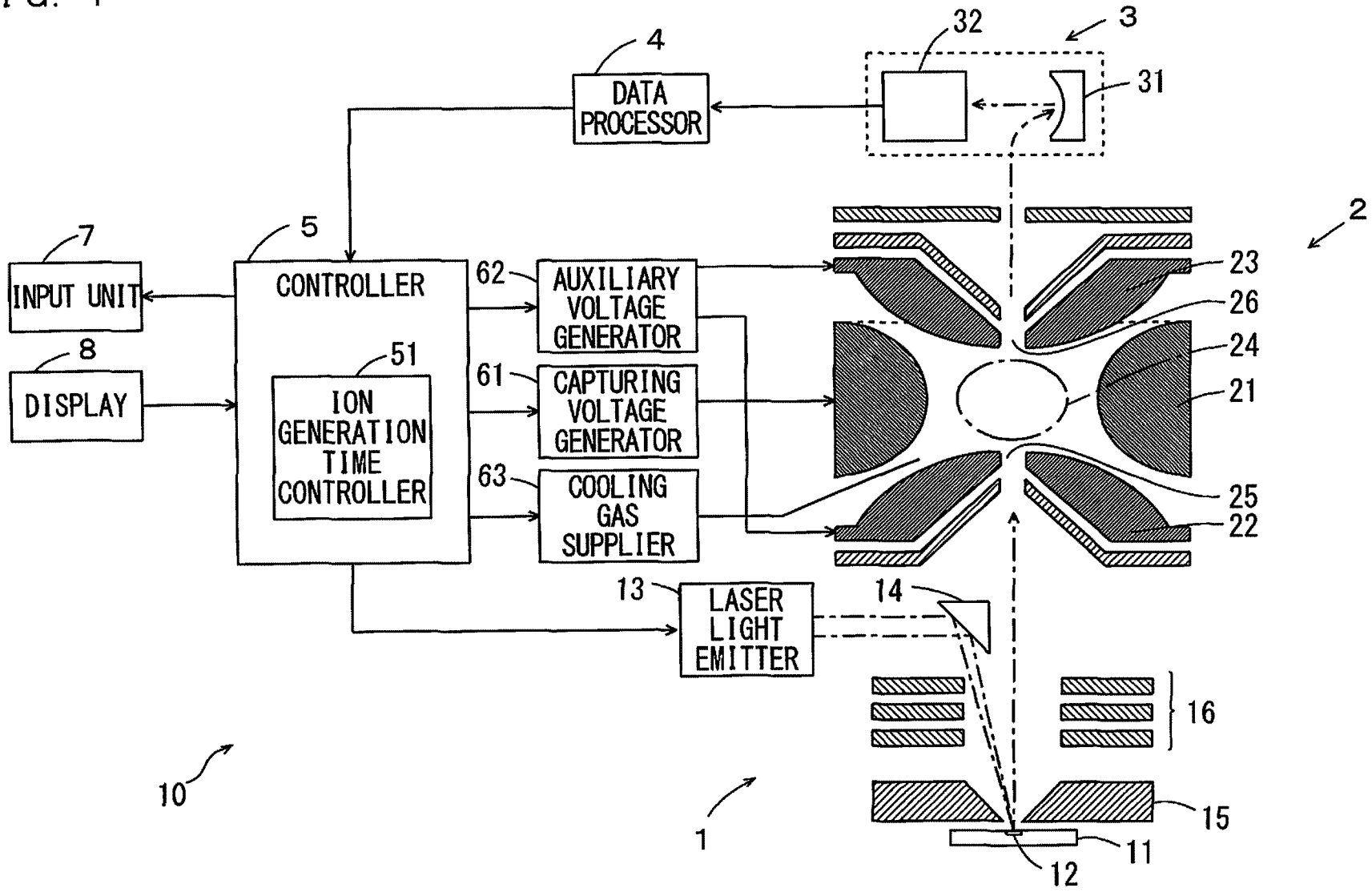
FIG. 1 is a diagram showing the overall configuration of a mass spectrometer according to the present embodiment.

FIG. 1 is a diagram showing the overall configuration of a mass spectrometer 10 according to the present embodiment. In the present embodiment, the mass spectrometer 10 is a Matrix Assisted Laser Desorption/Ionization Digital Ion Trap Mass Spectrometer (MALDI-DIT-MS). The mass spectrometer 10 includes a MALDI ion source 1 utilizing MALDI (Matrix Assisted Laser Desorption/Ionization), an ion trap 2, a detector 3, a data processor 4, a controller 5, an input unit 7 and a display 8. The MALDI ion source 1 is an example of an ion source in the present invention.

The MALDI ion source 1 irradiates a sample matrix mixture 12 prepared on a sample plate 11 with laser light, which is an ultraviolet ray. For example, CHCA (α-cyano-4-hydroxycinnamic acid) is utilized as a matrix. The MALDI ion source 1 includes a laser light emitter 13, a reflecting mirror 14, an aperture 15 and an einzel lens 16.

The laser light emitter 13 outputs laser light with which the sample matrix mixture 12 on the sample plate 11 is irradiated. A nitrogen laser or a YAG laser, for example, is used as the laser light. The reflecting mirror 14 changes the direction of the light path of the laser light that is output from the laser light emitter 13 to the direction towards the sample matrix mixture 12. The laser light, the light path of which is changed in the reflecting mirror 14, is collected at the sample matrix mixture 12 on the sample plate 11.

The aperture 15 is arranged between the sample plate 11 and the ion trap 2. The aperture 15 shields the diffusion of ions generated from the sample matrix mixture 12 to the surrounding. The einzel lens 16 is an ion transport optical system for transporting ions that have passed through the aperture 15 to the ion trap 2. As the ion transport optical system, various structures other than the einzel lens 16 such as an electrostatic lens optical system may be used.

The ion trap 2 is a three-dimensional quadrupole ion trap. The ion trap 2 includes an annular ring electrode 21 having an inner surface shaped like a hyperboloid of revolution of one sheet and a pair of end-cap electrodes 22, 23 having an inner surface shaped like a hyperboloid of revolution of two sheets. An ion trap region 24 is formed in the space surrounded by the ring electrode 21 and the end-cap electrodes 22, 23. An ion inlet port 25 is provided at the center of the end-cap electrode 22. An ion outlet port 26 is provided at the center of the end-cap electrode 23.

The ion trap 2 further includes a capturing voltage generator 61, an auxiliary voltage generator 62 and a cooling gas supplier 63. The capturing voltage generator 61 adds a square-wave voltage having a predetermined frequency to the ring electrode 21. The auxiliary voltage generator 62 respectively adds predetermined voltages (a direct-current voltage or a high frequency voltage) to the pair of end-cap electrodes 22, 23. The cooling gas supplier 63 supplies a cooling gas into the ion trap 2. An inert gas is generally used as a cooling gas, and the ions in the ion trap 2 are cooled.

The detector 3 includes a conversion dynode 31 and a secondary electron multiplier 32. The conversion dynode 31 is provided outside of the ion outlet port 26, and converts ions discharged from the ion trap 2 into electrons. The secondary electron multiplier 32 multiplies each electron that have been converted in the conversion dynode 31 and detect the multiplied electron. The detector 3 can detect both positive ions and negative ions. The electron detected in the detector 3 is supplied to the data processor 4 as a detection signal. The data processor 4 converts the detection signal received from the detector 3 into a digital detection signal, and performs an analysis process based on the digital detection signal. The data processor 4 produces a mass spectrum of ions based on the detection signal as one of the analysis processes.

The controller 5 includes an ion generation time controller 51. The functions of the ion generation time controller 51 will be described below. The input unit 7 receives operator's various operations with respect to the controller 5. The display 8 displays various setting information in the mass spectrometer 10, results of data processing by the data processor 4 and the like.

Figure 2:
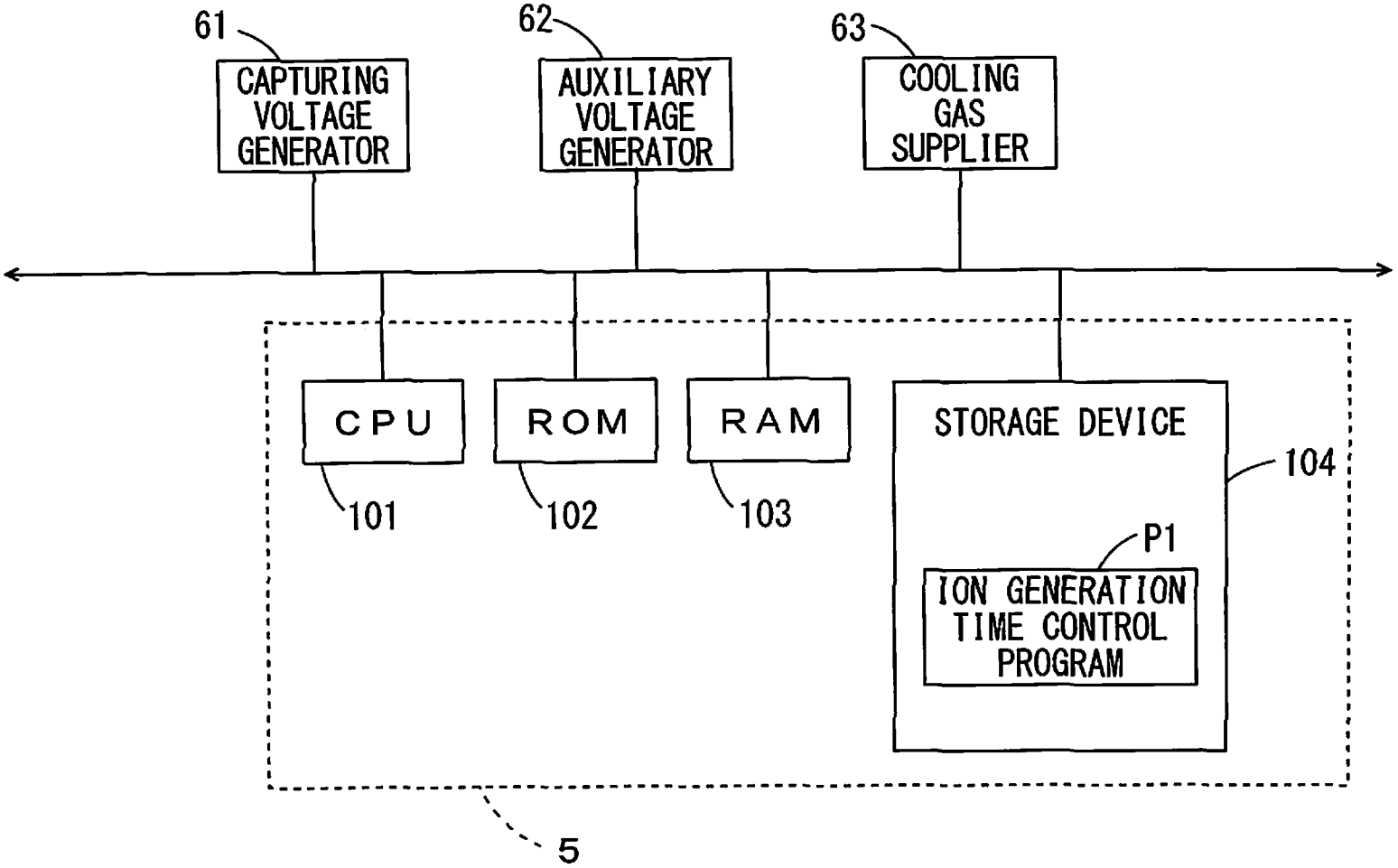
FIG. 2 is a block diagram showing a controller and functions around the controller.

FIG. 2 is a block diagram showing the configuration of the controller 5 and the configuration of the functions around the controller 5. The controller 5 includes a CPU 101, a ROM 102, a RAM 103 and a storage device 104. The CPU 101 controls the mass spectrometer 10 based on a control program stored in the ROM 102. The CPU 101 controls the capturing voltage generator 61 and the auxiliary voltage generator 62 by executing the control program, and allows the ions supplied from the MALDI ion source 1 to be captured in the ion trap 2. The CPU 101 controls the cooling gas supplier 63 by executing the control program and allows a cooling gas to be supplied to the ion trap 2 and cool the ions in the ion trap 2. The CPU 101 further controls the laser light emitter 13 by executing the control program and allows the laser light to be emitted to the sample matrix mixture 12.

(2) Operations of Mass Spectrometer

The mass spectrometer 10 having the above-mentioned configuration acquires a mass spectrum by performing the following operations. The laser light emitter 13 is controlled by the controller 5 to emit laser light to the sample matrix mixture 12. The time points at which laser light is emitted are controlled by the ion generation time controller 51. The method of controlling the time points at which the laser light is emitted will be described below. The ions generated from the sample matrix mixture 12 pass through the aperture 15 and the einzel lens 16 and are introduced into the ion trap 2 from the ion inlet port 25.

The capturing voltage generator 61 is controlled by the controller 5 to add a square-wave voltage having a predetermined frequency to the ring electrode 21. The introduced ions are captured in the ion trap region 24 by a capturing electric field formed by the square-wave voltage. The time point at which the square-wave voltage is added is controlled by the ion generation time controller 51. In the present embodiment, before ions are introduced into the ion trap 2, the ion generation time controller 51 controls the capturing voltage generator 61 and allows the capturing voltage generator 61 to add the square-wave voltage to the ring electrode 21. Further, prior to the introduction of ions into the ion trap 2, the cooling gas supplier 63 is controlled by the controller 5 to supply a cooling gas to the ion trap 2. The time point at which a cooling gas is supplied by the cooling gas supplier 63 is controlled by the ion generation time controller 51. The ions introduced into the ion trap 2 collide with the cooling gas. Thus, kinetic energy is reduced, and the ions are likely to be captured in the ion trap region 24.

The laser light emitter 13 is controlled by the ion generation time controller 51 to emit laser light to the sample matrix mixture 12 again with the ions captured in the ion trap 2. Thus, the ions generated from the MALDI ion source 1 are introduced additionally into the ion trap 2. Additional ions are not introduced efficiently into the ion trap 2 while ions are being captured in the ion trap 2, that is, a rectangular voltage is being added to the ring electrode 21. As such, in the mass spectrometer 10 of the present embodiment, the ion generation time controller 51 controls the time point at which laser light is emitted in order to introduce the additional ions efficiently into the ion trap 2. The method of controlling the time point at which the additional ions are introduced by the ion generation time controller 51 will be described below.

The auxiliary voltage generator 62 is controlled by the controller 5 to add a high frequency voltage to the end-cap electrodes 22, 23 with the square-wave voltage added to the ring electrode 21. Thus, the ions having a specific mass are resonantly excited (excitation). The excited ions having a specific mass are discharged from the ion outlet port 26 and detected in the detector 3. A detection signal for the ions detected in the detector 3 is supplied to the data processor 4.

The frequency of the square-wave voltage added to the ring electrode 21 by the capturing voltage generator 61 and the frequency of the high frequency voltage added to the end-cap electrodes 22, 23 by the auxiliary voltage generator 62 are scanned by the control of the controller 5, whereby the ions discharged from the ion outlet port 26 are scanned in regards to the differences in their masses. Thus, the ions on which mass-scan is performed and which are discharged sequentially are detected in the detector 3. Thus, the data processor 4 acquires a mass spectrum based on the detection signal supplied from the detector 3.

(3) Ion Generation Time Control Method

Next, an ion generation time control method according to the present embodiment will be described. As shown in FIG. 2, an ion generation time control program P1 is stored in the storage device 104. The ion generation time controller 51 shown in FIG. 1 is a function that is realized by execution of the ion generation time control program P1 by the CPU 101 while the CPU 101 uses the RAM 103 as a work area.

Figure 3:
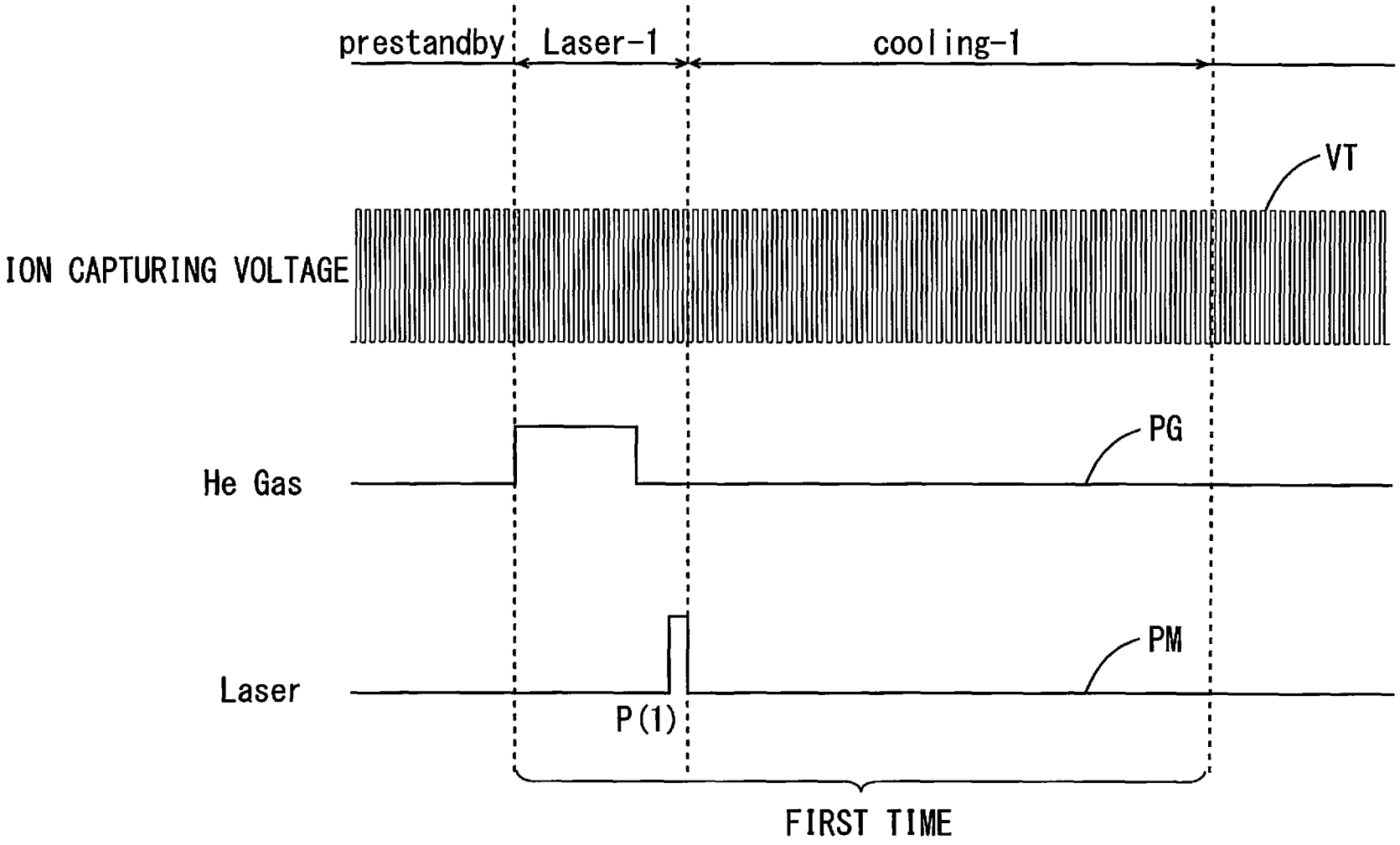
FIG. 3 is a time chart of a square-wave voltage added to a ring electrode, a cooling gas generation pulse signal and a laser light generation pulse signal PM.

FIG. 3 is a time chart of the square-wave voltage VT added to the ring electrode 21, a cooling gas generation pulse signal PG that is output by the controller 5 to the cooling gas supplier 63 and a laser light generation pulse signal PM that is output by the controller 5 to the laser light emitter 13. In the example of FIG. 3, a helium gas is used as the cooling gas. FIG. 3 is a diagram showing the time point at which the first cooling gas supply is carried out and the time point at which the first laser light emittance is carried out. As described below, the ion generation time controller 51 controls the time point at which the square-wave voltage VT is added to the ring electrode 21, the time point at which the cooling gas is supplied to the ion trap 2 and the time point at which the laser light is emitted by the laser light emitter 13.

As shown in FIG. 3, the ion generation time controller 51 starts addition of the square-wave voltage VT to the ring electrode 21 before the first laser light emittance by controlling the capturing voltage generator 61. A standby period (pre-standby) in FIG. 3 indicates the time period during which the square-wave voltage VT is added before the first laser light emittance.

As shown in FIG. 3, a first laser light emittance period (Laser-1) follows the standby period. The ion generation time controller 51 controls the cooling gas supplier 63 and allows the cooling gas supplier 63 to supply the cooling gas to the ion trap 2 in the first laser light emittance period (Laser-1). Subsequently, the ion generation time controller 51 controls the laser light emitter 13 and allows the laser light emitter 13 to emit the laser light to the sample matrix mixture 12 in the first laser light emittance period (Laser-1). In this manner, in the first laser light emittance period (Laser-1), the cooling gas is supplied, and then the laser light is emitted.

As shown in FIG. 3, a first cooling period (Cooling-1) follows the first laser light emittance period (Laser-1). During the first cooling period (Cooling-1), the ions that have already been captured in the ion trap 2 are not discharged towards the detector 3 and kept in the ion trap 2. Therefore, the ion generation time controller 51 controls the capturing voltage generator 61, and allows the capturing voltage generator 61 to add the square-wave voltage also during the first cooling period (Cooling-1) as shown in FIG. 3.

Figure 4:
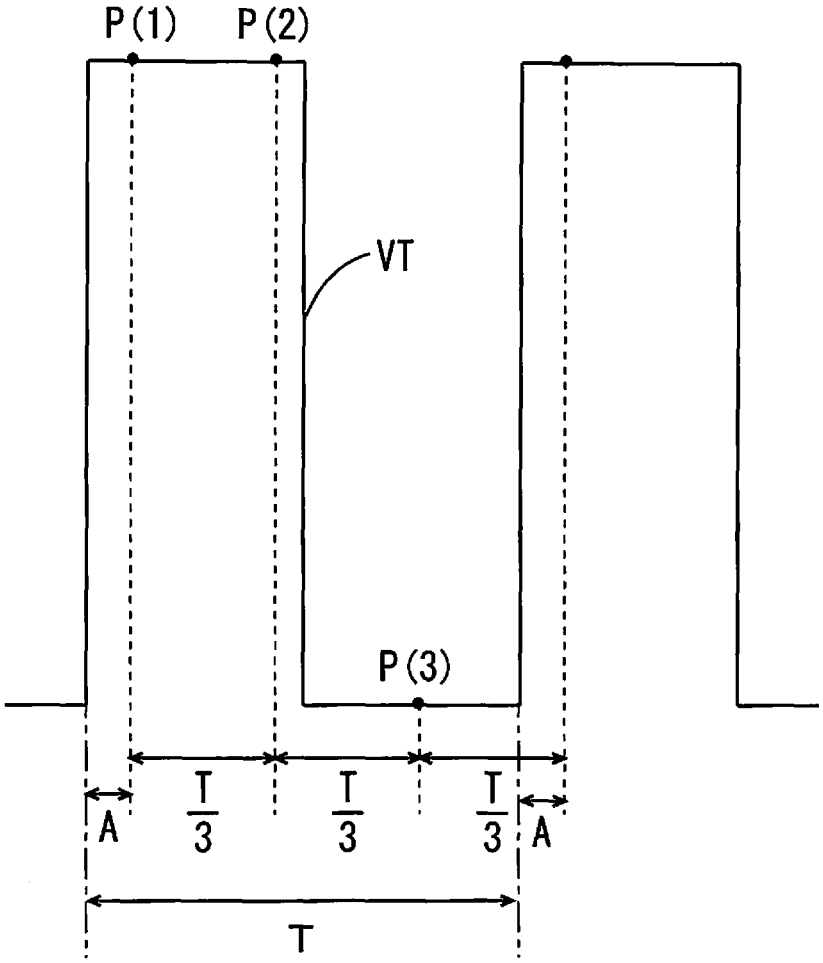
FIG. 4 is a diagram showing the relationship between a voltage value of one period of a square-wave voltage added to the ring electrode and the time points at which laser light is emitted.

FIG. 4 is a diagram showing the relationship between a voltage value of the square-wave voltage VT added to the ring electrode 21 in one period and phase time points P(1), P(2), P(3) of the laser light. In the present embodiment, the ions generated by three-time laser light emittance are captured in the ion trap 2. As shown in FIG. 4, the ion generation time controller 51 controls the laser light emitter 13, and allows the laser light emitter 13 to emit the laser light at the three phase time points P(1), P(2), P(3).

The three phase time points P(1), P(2), P(3) are assigned to different periods of the square-wave voltage VT added to the ring electrode 21. While the three phase time points P(1), P(2), P(3) are shown in the same period of the square-wave voltage VT in FIG. 4, the three phase time points P(1), P(2), P(3) are actually assigned to different periods of the square-wave voltage VT.

In the example of FIG. 4, when letting one period of the square-wave voltage VT be Tμs, the three phase time points P(1), P(2), P(3) are set at intervals of (T/3)μs. The first phase time point P(1) may be set at any time point. In other words, the first phase time point P(1) may be set at any time point in the one period of the square-wave voltage VT. In the example of FIG. 4, the first phase time point P(1) is set at Aμs from the start of the one period of the square-wave voltage VT. Therefore, the second phase time point P(2) is set at (A+T/3)μs from the start of the one period of the square-wave voltage VT. The third phase time point P(3) is set at (A+2T/3)μs from the start of the one period of the square-wave voltage VT. The start time A can be set freely.

Figure 5:
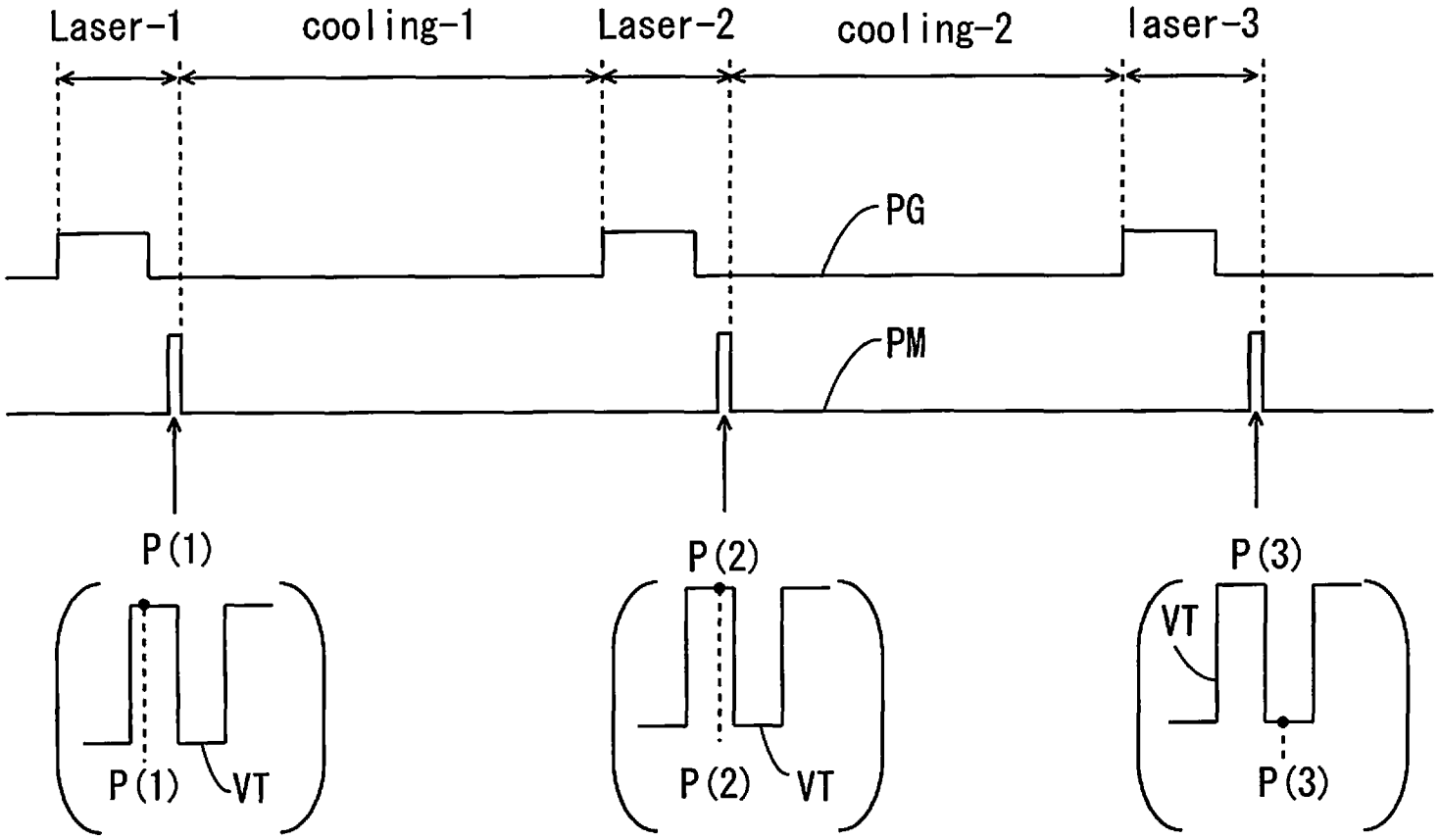
FIG. 5 is a time chart of the cooling gas generation pulse signal and the laser light generation pulse signal PM.

FIG. 5 is a time chart of the cooling gas generation pulse signal PG that is output by the controller 5 to the cooling gas supplier 63 and the laser light generation pulse signal PM that is output by the controller 5 to the laser light emitter 13. Specifically, FIG. 5 is a diagram showing the time points at which the first to third cooling gas supply are carried out and the time points at which the first to third laser light emittance are carried out. While the square-wave voltage VT added to the ring electrode 21 is not described in the diagram, the square-wave voltage VT is added to the ring electrode 21 in all of the periods shown in FIG. 5. That is, the capturing voltage generator 61 adds the square-wave voltage VT similarly to the description of FIG. 3 in all of the periods shown in FIG. 5.

FIG. 5 shows first to third laser light emittance periods (Laser-1 to Laser-3). Further, FIG. 5 shows first and second cooling periods (Cooling-1 and Cooling-2).

First, the first cooling gas supply is carried out in the first laser light emittance period (Laser-1). Subsequently, the laser light emitter 13 emits the laser light to the sample matrix mixture 12 at the first phase time point P(1) in the first laser light emittance period (Laser-1). The standby period (pre-standby) shown in FIG. 3 is provided before the first laser light emittance period (Laser-1), and addition of the square-wave voltage VT by the capturing voltage generator 61 is started in the standby period.

The first cooling period (Cooling-1) is provided to follow the first laser light emittance period (Laser-1). During the first cooling period (Cooling-1), the addition of the square-wave voltage VT by the capturing voltage generator 61 is continued. The cooling periods are provided in this manner since next introduction of ions cannot be carried out efficiently with the cooling gas spreading outside of the ion trap 2, in particular, around the ion inlet port 25. Although the first laser light emittance is carried out right after the first cooling gas supply, because the cooling gas has not spread to the outside of the ion trap 2 yet at this point in time, ions are introduced efficiently into the ion trap 2. Also in regards to the second and third cooling gas supply and second and third laser light emittance, ions are introduced efficiently into the ion trap 2 right after the cooling gas supply. After that, the cooling gas spreads to the outside of the ion trap 2, so that a cooling period is required for next introduction of ions until the concentration of the cooling gas outside of the ion trap 2 is reduced.

The second laser light emittance period (Laser-2) is provided to follow the first cooling period (Cooling-1). During the second laser light emittance period (Laser-2), the second cooling gas supply is carried out. Subsequently, at the second phase time point P(2) in the second laser light emittance period (Laser-2), the laser light emitter 13 emits the laser light to the sample matrix mixture 12. The second phase time point P(2) is (T/3)μs later than the first phase time point P(1). The ions generated by the first and second laser light emittance are captured in the ion trap 2 after the second laser light emittance.

The second cooling period (Cooling-2) is provided to follow the second laser light emittance period (Laser-2). Also during the second cooling period (Cooling-2), the addition of the square-wave voltage VT by the capturing voltage generator 61 is continued similarly.

The third laser light emittance period (Laser-3) is provided to follow the second cooling period (Cooling-2). During the third laser light emittance period (Laser-3), the third cooling gas supply is carried out. Subsequently, at the third phase time point P(3) in the third laser light emittance period (Laser-3), the laser light emitter 13 emits the laser light to the sample matrix mixture 12. The third phase time point P(3) is (T/3)μs later than the second phase time point P(2). The ions generated by the first to third laser light emittance are captured in the ion trap 2 after the third laser light emittance.

After the third laser light emittance period (Laser-3), the auxiliary voltage generator 62 adds a high frequency voltage to the end-cap electrodes 22, 23. Thus, as described above, the excited ions having a specific mass are detected in the detector 3. Then, the ions on which mass-scan is performed and which are discharged sequentially are detected in the detector 3.

Figure 6:
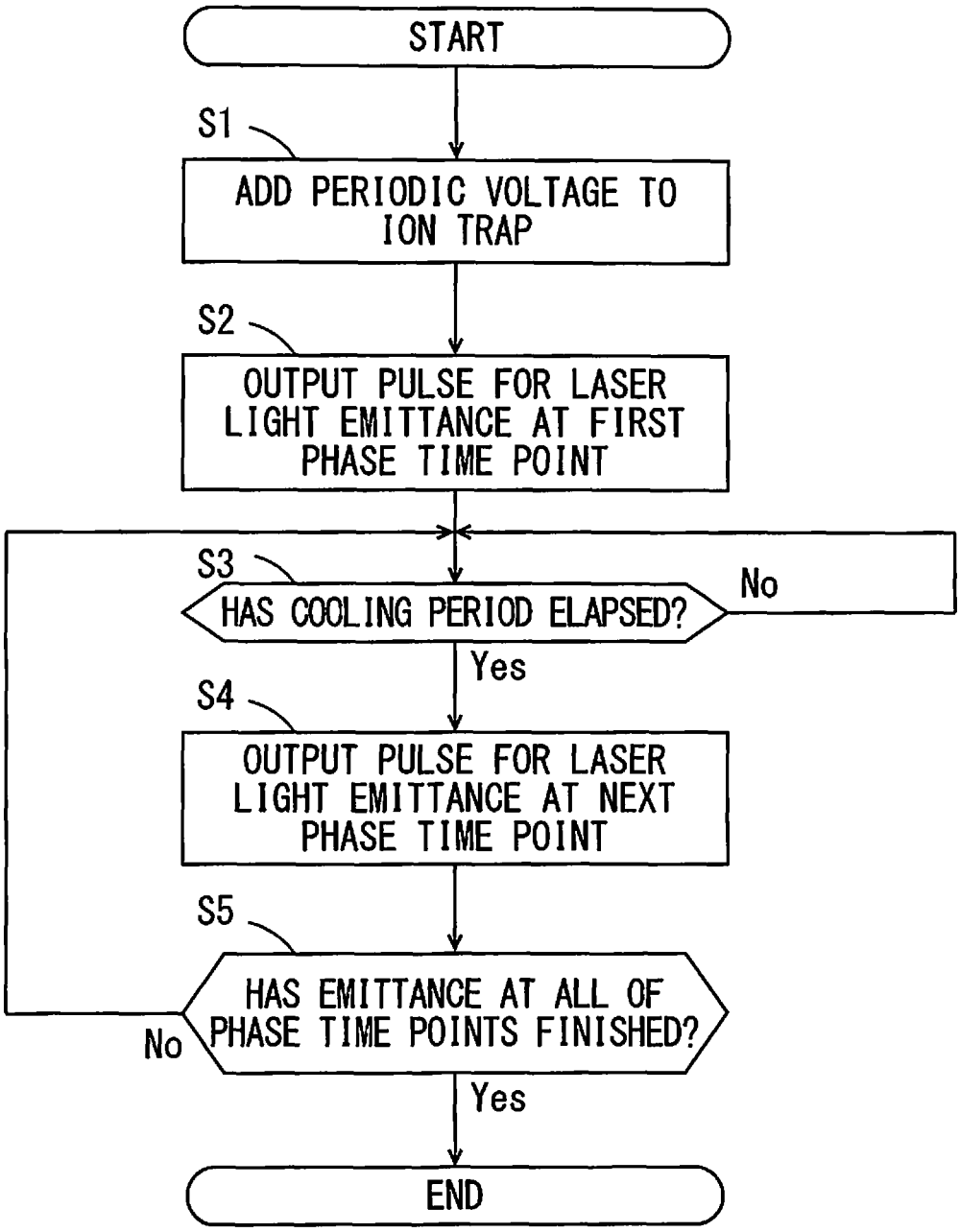
FIG. 6 is a flow chart showing the ion generation time control method according to the present embodiment.

FIG. 6 is a flow chart showing a laser light intensity adjusting method according to the present embodiment. First, the ion generation time controller 51 controls the capturing voltage generator 61 and adds a square-wave voltage having a predetermined frequency to the ring electrode 21. Thus, a capturing electric field is formed in the ion trap 2 (step S1).

Next, the ion generation time controller 51 outputs a pulse signal for laser light emittance to the laser light emitter 13 at the first phase time point P(1) (step S2). Thus, the laser light emitter 13 emits the laser light to the sample matrix mixture 12. As explained with reference to FIG. 5, the cooling gas is supplied to the ion trap 2 prior to the emittance of laser light.

After the step S2, the ion generation time controller 51 determines whether the cooling period has elapsed (step S3). When determining that the cooling period has elapsed, the ion generation time controller 51 outputs a pulse signal for laser light emittance to the laser light emitter 13 at the second phase time point P(2) (step S4). Thus, the laser light emitter 13 emits the laser light to the sample matrix mixture 12. Similarly to the first time, a cooling gas is supplied to the ion trap 2 prior to the emittance of laser light.

After the step S4, the ion generation time controller 51 determines whether the laser light emittance at all of the phase time points has finished (step S5). In the example of FIG. 5, the number of the phase time points is three: P(1), P(2) and P(3). In this case, the ion generation time controller 51 again performs the step S3 and the step S4 to perform a process in regards to the third phase time point P(3). When the laser light emittance at all of the phase time points has finished, the ion generation time controller 51 ends the process.

As described above, the mass spectrometer 10 of the present embodiment allows pulse-form ions to be generated from the MALDI ion source 1 at N (three in the above-mentioned example) phase time points during a period in which addition of the periodic voltage is continued in the ion trap 2. When the pulse-form ions generated from the MALDI ion source 1 are introduced into the ion trap 2, an occurrence of waveform deformation in a periodic voltage is prevented. That is, in the above-mentioned example, the square-wave voltage is added to the ring electrode 21 already in the standby period (pre-standby) before the first laser light emittance period (Laser-1). Therefore, when the first laser light emittance is carried out, the square-wave voltage is stable in the waveform. Thus, the ions introduced from the MALDI ion source 1 are captured efficiently in the ion trap 2.

Further, the mass spectrometer 10 of the present embodiment allows the ions generated from the MALDI ion source 1 at the N (three in the above-mentioned example) phase time points to be captured in the ion trap 2. Because the ions generated by N-time laser light emittance are captured in the ion trap 2, the amount of ions acquired by a one-time mass separation-detection process is increased.

When ions are generated from the MALDI ion source 1 at the N phase time points, the square-wave voltage is added to the ring electrode 21. That is, when ions are generated from the MALDI ion source 1 at the N phase time points, a capturing electric field is formed in the ion trap 2. Therefore, while the ions that arrive when an ion cloud in the ion trap 2 is changing from an expanded state to a reduced state are likely to be introduced into the ion trap 2, the ions that arrive when the ion cloud in the ion trap 2 is changing from the reduced state to the expanded state are unlikely to be introduced into the ion trap 2. Further, the time length required for the ions generated from the MALDI ion source 1 to arrive at the ion trap 2 depends on the mass of ions. As such, in the mass spectrometer 10 of the present embodiment, the N phase time points are set in the one period of the periodic voltage, so that the ions having masses in a wide range are captured in the ion trap 2 without restriction to the specific mass. The larger the numeric value of N is, the wider the range of the mass of the ions that are captured in the ion trap 2 is.

(4) Mass Spectrum of Ions Generated at N Phase Time Points

Figure 7:
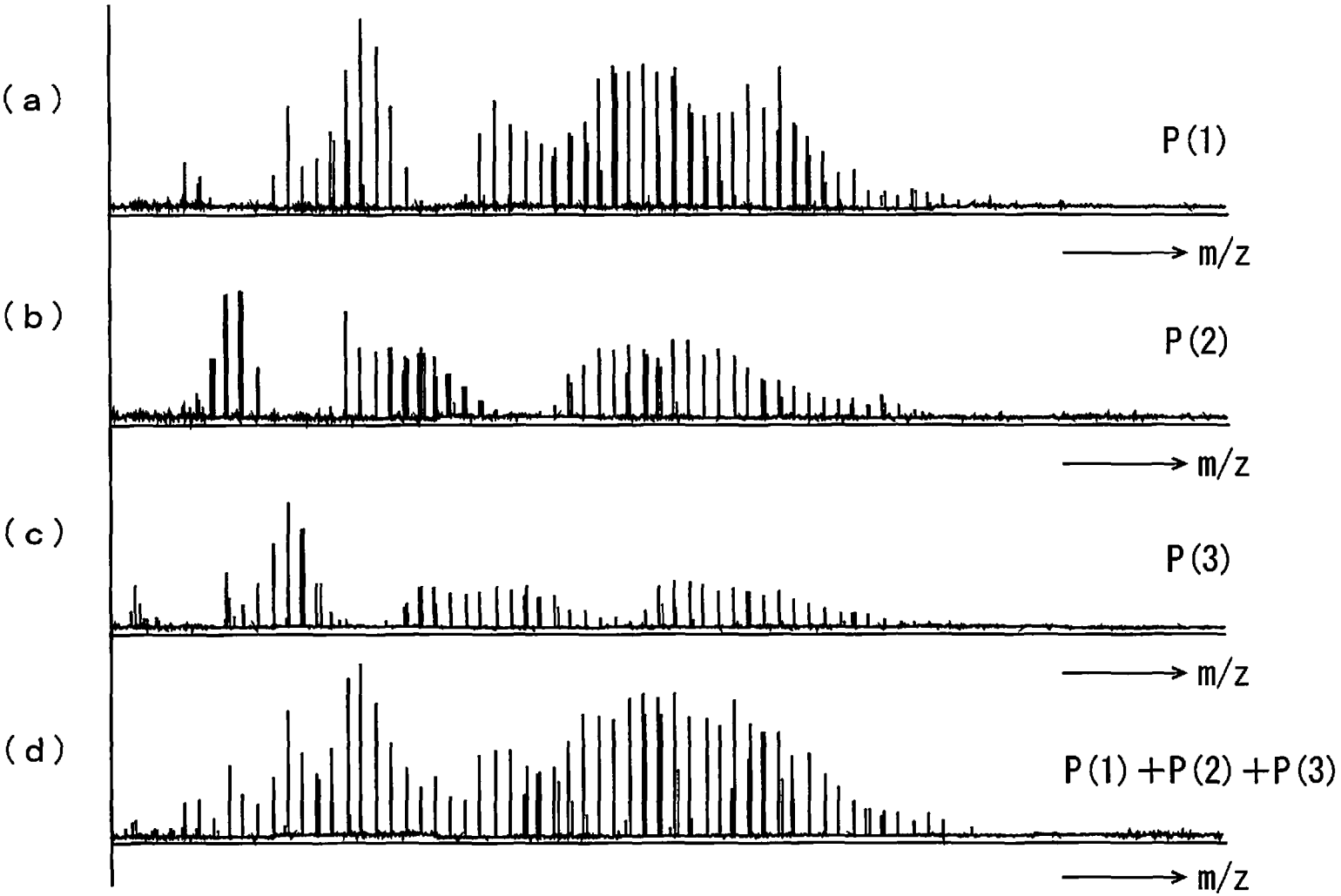
FIGS. 7(*a*) to 7(*d*) are diagrams showing mass spectrums acquired by the ion generation time control method according to the present embodiment.

FIGS. 7(*a*) to 7(*d*) are diagrams showing the mass spectrums acquired by the ion generation time control method according to the present embodiment. FIG. 7(*a*) shows the mass spectrum of the ions detected by laser light emittance only at the first phase time point P(1) shown in FIG. 5. FIG. 7(*b*) shows the mass spectrum of the ions detected by laser light emittance only at the second phase time point P(2) shown in FIG. 5. FIG. 7(*c*) shows the mass spectrum of the ions detected by laser light emittance only at the third phase time point P(3) shown in FIG. 5. That is, FIGS. 7(*a*) to 7(*c*) show the mass spectrums acquired by analysis of the ions respectively generated by the one-time laser light emittance. FIG. 7(*d*) shows the mass spectrum of the ions detected by laser light emittance at all of the first to third phase time points P(1) to P(3) shown in FIG. 5.

It is found that, in FIGS. 7(*a*) to 7(*c*), although spectrums are acquired in parts of a mass region, spectrums are not acquired in parts of the mass region. That is, in FIGS. 7(*a*) to 7(*c*), the laser light is emitted to the MALDI ion source 1 only one time in the one period T of the square-wave voltage VT added to the ring electrode 21. Therefore, among the ions generated from the MALDI ion source 1, the ions that have such a mass, thus arriving in the ion trap 2 when an ion cloud is changing from the expanded state to the reduced state are likely to be captured in the ion trap 2. In contrast, among the ions generated from the MALDI ion source 1, the ions that have such a mass, thus arriving in the ion trap 2 when the ion cloud is changing from the reduced state to the expanded state are unlikely to be captured in the ion trap 2.

In the meantime, in FIG. 7(*d*), the laser light is emitted at all of the three phase time points P(1) to P(3). Therefore, in the one period of the square-wave voltage VT added to the ring electrode 21, the laser light is emitted to the MALDI ion source 1 at three different times. Thus, at the three respective time points, the ions that have such a mass, thus arriving in the ion trap 2 when the ion cloud is changing from the expanded state to the reduced state are captured. The mass spectrum of FIG. 7(*d*) shows the result of analysis close to the mass spectrum acquired by integration of the three mass spectrums of FIGS. 7(*a*) to 7(*c*).

(5) Other Embodiments

In the above-mentioned embodiment, the MALDI ion source 1 is described as one example of the ion source of the present invention. The ion source is not limited to the MALDI ion source, and it is acceptable as long as the ion source can generate pulse-form ions. For example, an ESI ion source utilizing ESI (Electro Spray Ionization) is used. When the ESI ion source is used, a gate that shields or pass generated ions is provided to generate pulse-form ions from the ESI ion source.

In the above-mentioned embodiment, the number of phase time points at which the laser light emitter 13 emits the laser light to the sample matrix mixture 12 is three in the one period T of the square-wave voltage added to the ring electrode 21. The number of phase time points is three by way of example, and may be two, four or more. While the time length required for analysis is increased due to an increase in number of phase time points at which the laser light is emitted in the one period, more accurate mass spectrometry can be carried out.

In the above-mentioned embodiment, respective time lengths between two phase time points at which the laser light emitter 13 emits the laser light to the sample matrix mixture 12 are equally third of the one period T of the square-wave voltage added to the ring electrode 21. However, respective time lengths between two phase time points at which the laser light is emitted do not have to be equal to one another, and the phase time points do not have to be assigned to equally divide the one period T of the square-wave voltage. For example, when letting the one period T of the square-wave voltage be 3 μs, respective time lengths between two phase time points are 1 μs in the example of the above-mentioned embodiment where the one period T is equally divided into three periods. As another embodiment, letting the one period T of the square-wave voltage be 3 μs, respective time lengths between two phase time points do not have to be equal to one another. For example, the one period T may be divided by the three phase time points into the time periods of 0.8 μs, 1 μs and 1.2 μs.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. A mass spectrometer comprising:

an ion source that generates ions;

an ion trap that captures the ions generated from the ion source;

a detector that detects the ions ejected from the ion trap; and a controller that controls a periodic voltage, which is added to form a capturing electric field in the ion trap and controls a time point at which the ions are generated from the ion source, wherein the controller includes an ion generation time controller that allows the ions to be generated from the ion source at N (N is an integer equal to or larger than 2) phase time points while addition of the periodic voltage is continued, the N phase time points being set in one period of the periodic voltage and being respectively assigned to different periods of the periodic voltage.

2. The mass spectrometer according to claim 1, wherein the periodic voltage includes a square wave.

3. The mass spectrometer according to claim 1, wherein the ion generation time controller sets the N phase time points by equally dividing the one period of the periodic voltage into N.

4. The mass spectrometer according to claim 1, wherein the ion generation time controller sets a period of a voltage to which the N phase time points are assigned with cooling periods respectively provided between two phase time points.

5. The mass spectrometer according to claim 1, wherein the ion source includes a MALDI ion source utilizing MALDI (Matrix Assisted Laser Desorption/Ionization).

6. An ion generation time control method in a mass spectrometer, including:

forming a capturing electric field for capturing ions generated from an ion source in an ion trap by adding a periodic voltage; and generating the ions from the ion source at N (N is an integer equal to or larger than 2) phase time points while addition of the periodic voltage is continued, the N phase time points being set in one period of the periodic voltage and being respectively assigned to different periods of the periodic voltage.

7. A non-transitory computer readable medium storing an ion generation time control program in a mass spectrometer, the ion generation time control program in the mass spectrometer, allowing a computer to perform:

a process of controlling a periodic voltage added to form a capturing electric field for capturing ions generated from an ion source in an ion trap; and a process of generating the ions from the ion source at N (N is an integer equal to or larger than 2) phase time points while addition of the periodic voltage is continued, the N phase time points being set in one period of the periodic voltage and being respectively assigned to different periods of the periodic voltage.

* * * * *